US006431147B1

(12) United States Patent
Hiraiwa et al.

(10) Patent No.: US 6,431,147 B1
(45) Date of Patent: Aug. 13, 2002

(54) FUEL FEED DEVICE AND FUEL PRESSURE REGULATOR

(75) Inventors: Masaru Hiraiwa; Shigeki Kanamaru, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/744,394

(22) PCT Filed: May 26, 1999

(86) PCT No.: PCT/JP99/02765

§ 371 (c)(1),
(2), (4) Date: Mar. 13, 2001

(87) PCT Pub. No.: WO00/73646

PCT Pub. Date: Dec. 7, 2000

(51) Int. Cl.[7] ..... F02M 37/04
(52) U.S. Cl. ..... 123/458; 123/497
(58) Field of Search ..... 123/497, 457, 123/458, 514, 511

(56) References Cited

U.S. PATENT DOCUMENTS 5,406,922 A * 4/1995 Tuckey ..... 123/497
5,507,266 A * 4/1996 Wright et al. ..... 123/497
5,762,047 A 6/1998 Yoshioka et al.
5,765,535 A * 6/1998 Radermacher ..... 123/497
5,842,454 A * 12/1998 Miwa et al. ..... 123/497
5,848,583 A * 12/1998 Smith et al. ..... 123/497
5,850,818 A * 12/1998 Yoshiume et al. ..... 123/497
6,067,963 A * 5/2000 Oi et al. ..... 123/497

FOREIGN PATENT DOCUMENTS

| | | |
|---|---|---|
| JP | 3-011146 | 1/1991 |
| JP | 8-246973 | 9/1996 |
| WO | WO96/23967 | 8/1996 |

* cited by examiner

*Primary Examiner*—Thomas N. Moulis
(74) *Attorney, Agent, or Firm*—Sughrue Mion, PLLC

(57) ABSTRACT

Mounted on the upper surface of the cover portion (*3*) of a fuel supplying apparatus (10) to be mounted to an opening portion (2*a*) of a fuel tank (2) is a fuel pressure regulator (20), which contains a fuel pressure detector portion (21) constituted by a diaphragm portion (21*a*) detecting a pressure of the fuel discharged from a fuel pump (4) and a current control portion (22) for analogue-controlling the current flowing through the fuel pump (4) by a signal from the fuel pressure detector portion (21), whereby the fuel pump (4) is set to pump an amount of the fuel corresponding to that required by the injector mounted to the engine, so that the current consumption of the fuel pump (4) is reduced and the operating noise is lowered.

7 Claims, 5 Drawing Sheets

FUEL FEED DEVICE AND FUEL PRESSURE REGULATOR

TECHNICAL FIELD

This invention relates to a furl supplying apparatus mounted within a fuel tank of an automobile or the like for supplying fuel under pressure to an injector which injects fuel to an engine.

BACKGROUND ART

FIG. 5 is a sectional side view of the conventional fuel supplying apparatus disclosed in International Publication No. WO96/23967.

In the figure, a fuel supplying apparatus 1 which comprises as an assembly a cover 3, a fuel pump 4, a fuel filter 5, a pressure regulator 6, a discharge pipe 7, an unillustrated fuel level indicator and an unillustrated electrical connector is suspended from an opening 2*a* of a fuel tank 2 made of a metal or a resin.

The fuel filter 5 comprises a holder member 5*a* made of an electrically conductive resin and a filter element contained therein and is welded to a boundary 8 between the cover 3 in a liquid-tight manner. The holder member 5*a* holds the fuel pump 4 at its central portion and the pressure regulator 6 at the lower end portion. A gasket 9 for the gas-tight seal is interposed between the cover 3 and the fuel tank 2.

In the holder member 5*a* of the fuel filter 5, an inlet portion 10 as a fuel inlet for the fuel filter 5 is disposed at the upper portion of the inner circumference of the holder member 5*a* and is connected to the discharge pipe 11 of the fuel pump 4 through a seal 10*a*. Also, the holder member 5*a* of the fuel filter 5 has two fuel outlets, a pipe 12 (shown by a dot-and-dash line) constituting the first fuel outlet extending axially upwardly from the bottom end of the holder member 5*a*. The pipe 12 is connected to the discharge pipe 7 to supply the filtered fuel to the injector. A return path 13 constituting the second fuel outlet is disposed at the lower portion of the holder member 5*a* and is connected to the pressure regulator 6.

14 is a strainer for filtering fuel before it is suctioned into the fuel pump 4 against any foreign matters such as iron powders within the fuel tank 2.

The pressure regulator 6 is inserted at its base 6*a* into insertion portion 5*c* extending downwardly from the bottom of the holder member 5*a* and is fixed thereto. A diaphragm 6*c* is held between the open end of the housing 6*a* and the housing 6*b*, and the diaphragm 6*c* supports a movable valve seat 6*e* having an discharge hole 6*d*.

Within the base 6*a*, a stationary valve seat 6*f* that co-operates with the movable valve seat 6*e* is fixed. Between the housing 6*b* and the diaphragm 6*c*, a spring 6*g* is received and a exhaust port 6*h* for discharging the fuel from the discharge hole 6*d* into the fuel tank 2 is disposed at the lower portion of the hosing 6*b*.

4*a* a current supply unit for supplying an electric current to an unillustrated motor of the fuel pump 4 and electrically connected to an unillustrated electrical connector integrally formed with the cover 3.

In the fuel supply apparatus thus constructed 1, when an electric current is supplied to the unillustrated motor of the fuel pump 4 from the unillustrated electrical connector through the current supply portion 4*a*, the motor rotates, and the fuel within the fuel tank 2 is suctioned through the strainer 14 and after discharged from the discharge pipe 11 flows through a passage 15 in the direction of an arrow A to pass through the filter element 5*b* to reach to a lower space 16 defined under the filter element 5*b*.

One part of the fuel is flowed into the pressure regulator 6 and, when the fuel pressure becomes higher than the set pressure of the spring 6*g*, the diaphragm 6*c* is moved toward the housing 6*b* to open the discharge hole 6*f* of the movable valve seat 6*e* so that the fuel within the base 6*a* is returned through the discharge port 6*h* to the fuel tank 2 again. The other part of the fuel flows through the pipe 12 in the direction of an arrow B to be supplied to the injector of a fuel injection apparatus mounted to an unillustrated engine through the discharge pipe 7.

In the conventional fuel supplying apparatus, the motor of the fuel pump 4 is supplied with a constant continuous electric power so that a constant amount of fuel is pumped from the fuel tank 2, and the fuel demanded by the injector associated with the engine is supplied through the discharge pipe 7 and the excessive amount of fuel is all returned to the fuel tank 2 from the discharge hole 6*d* of the pressure regulator 6 through the discharge port 6*h*.

The fuel pump 4 is set to pump an amount of the fuel equal to or more than that required by the engine at the time of the maximum load. However, the fuel amount required by the engine injector during idling is small, so that most of the pumped fuel is returned to the fuel tank 2 through the discharge port 6*h* of the pressure regulator 6.

As discussed above, the fuel pump motor is always driven at the full power irrespective of the fuel amount required by the injector, so that the electric current consumption of the fuel pump 4 is high and the load to the battery mounted on the vehicle is high. Also, since the motor of the fuel pump 4 is operated at a high speed even when the engine noise is low such as during the idling, the operating noise of the fuel pump 4 is high.

This invention has been made to solve the above-discussed problems and has as its object the provision of a fuel supplying apparatus in which the fuel pump is operated to discharge an amount of the fuel corresponding to the fuel amount required by the injector, whereby the current consumption of the fuel pump is reduced and the operating noise is lowered.

DISCLOSURE OF INVENTION

The fuel supplying apparatus of the present invention comprises a cover portion installed to an opening portion of a fuel tank and having an outlet pipe disposed thereon, a fuel pump for pumping fuel within the fuel tank to an injector of an engine through the outlet pipe, a fuel filter for filtering the fuel discharged from the fuel pump, and a fuel pressure regulator for detecting the pressure of the fuel discharged from the fuel pump and regulating the discharge pressure of the fuel discharged from the pump according to the detected fuel pressure.

The fuel pressure regulator may comprise a fuel pressure detection portion and a current control portion for controlling the current flowing through the fuel pump according to a signal from the fuel pressure detection portion.

The fuel pressure regulator may comprise a diaphragm portion displaceable in response to the fuel pressure, a compression spring for adjusting the displacement amount of the diaphragm portion and a shaft for guiding the movement of the diaphragm in a predetermined direction.

The current control portion may be composed of an analogue circuit comprising a variable resistor of which resistance varies according to the amount of displacement of the shaft, and a transistor of which base current is controlled according to the variable resistor.

Further, the present invention resides in a fuel pressure regulating apparatus comprising a suction portion for suctioning fuel, a fuel pressure detection portion for detecting fuel pressure, and a current control portion for controlling a current flowing through a fuel pump according to a signal from the fuel pressure detection portion.

BRIEF DESCRIPTION OF THE DRAWINGS

The present invention will become more readily apparent from the following detailed description of the preferred embodiments of the present invention taken in conjunction with the accompanying drawings, in which.

BEST MODES FOR CARRYING OUT THE INVENTION

Figure 1:
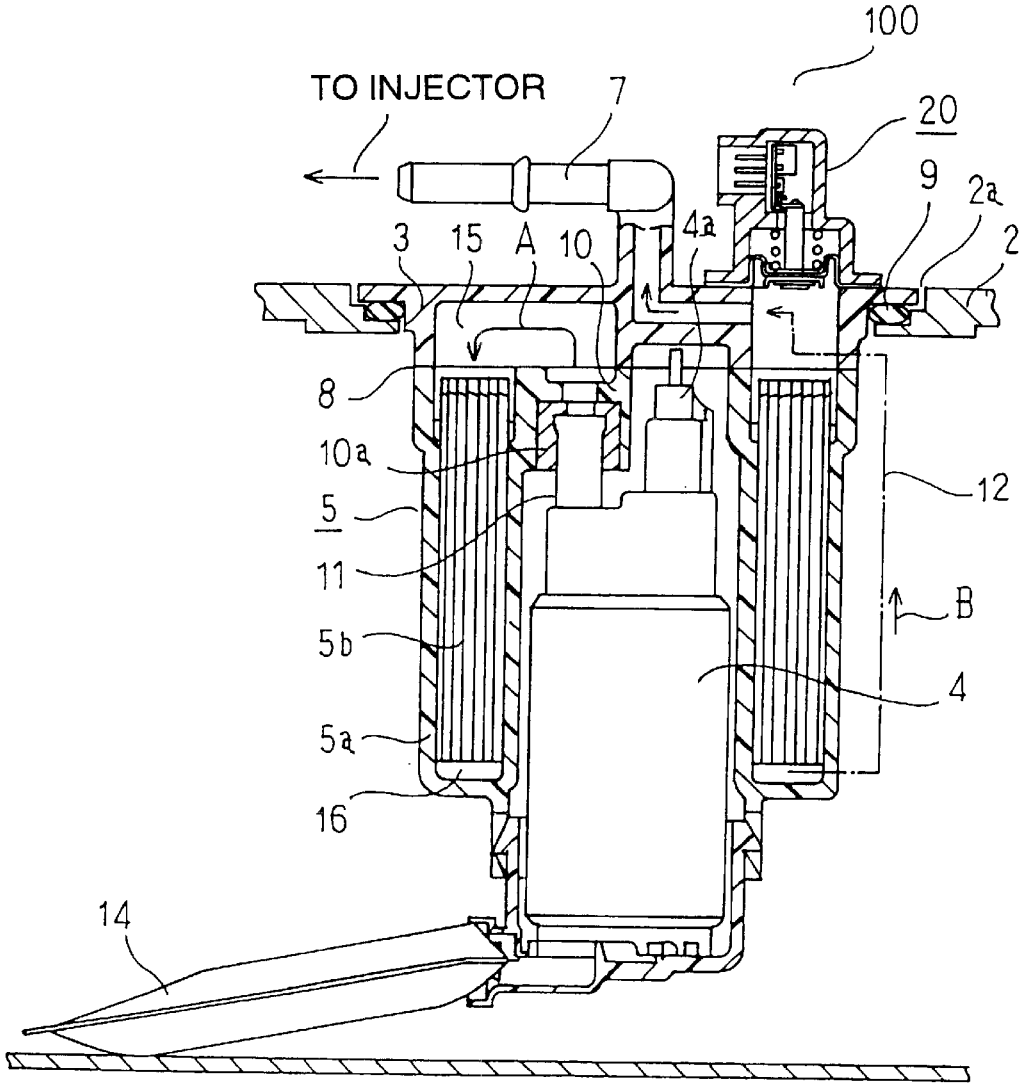
FIG. 1 is a sectional side view of the fuel supplying apparatus of one embodiment of the present invention.

FIG. 1 is a sectional side view of the fuel supplying apparatus of one embodiment of the present invention, in which a fuel supplying apparatus 100 which comprises as an assembly a cover 3, a fuel pump 4, a discharge pipe 7, a strainer 14, a fuel pressure regulator 20 and a fuel level indicator (not shown) is suspended from an opening 2*a* of a fuel tank 2 made of a metal or a resin.

The fuel filter 5 comprises a holder member 5*a* made of an electrically conductive resin and a filter element contained therein and is welded to a boundary 8 between the cover 3 in a liquid-tight manner. The holder member 5*a* holds a pipe 12 (shown by a dot-and-dash line) which is a fuel outlet of the fuel filter 5, the pipe 12 extending axially upwardly from the bottom end.

The pipe 12 is connected to the discharge pipe 7 to supply the filtered fuel to the injector. A fuel pressure regulator 20 is disposed on the upper surface of the cover 3 of the passage (hereinafter referred to as a fuel pipe) for flowing the fuel connected to the injector through the discharge pipe 7 from the pipe 12 and detects the fuel pressure. 14 is a strainer for filtering fuel before it is suctioned into the fuel pump 4 against any foreign matters such as iron powders within the fuel tank 2.

Figure 2A:
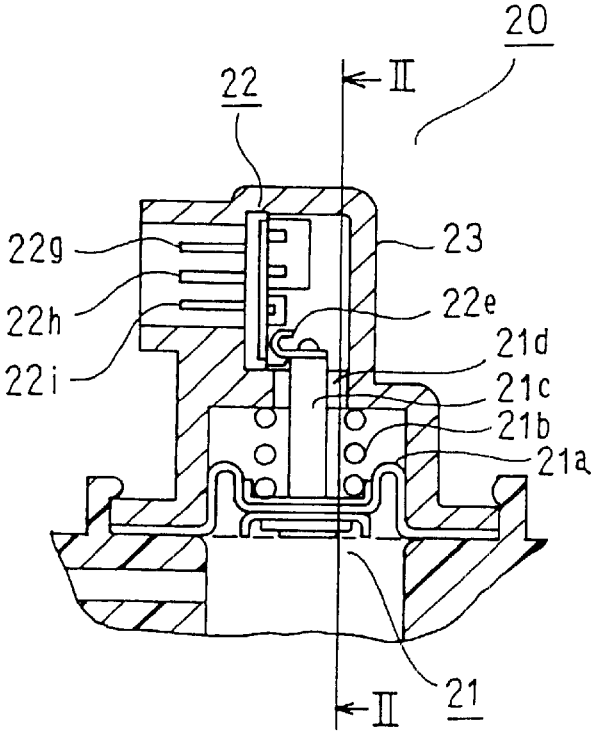
FIG. 2*a* and 2*b* are enlarged view of the fuel pressure regulator shown in FIG. 1.
Figure 2B:
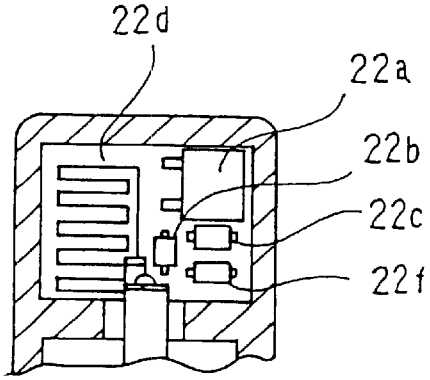

FIG. 2*a* and 2*b* are enlarged side views of the fuel pressure regulator shown in FIG. 1, and (a) is a sectional side view and (b) is a sectional view taken along lien II—II of FIG. 2*a*.

In the figures, the fuel pressure regulator 20 comprises a fuel pressure detector unit 21, a current control unit 22 and a case 23.

The fuel pressure detector unit 21 comprises a diaphragm portion 21*a* displaceable in response to the fuel pressure, a compression spring 21*b* for adjusting the displacement amount of the diaphragm portion 21*a,* a shaft 21*c* for guiding the movement of the diaphragm 21*a* in a predetermined direction and a bearing 21*d* for holding and making the shaft 21*c* slidable.

The current control portion 22 comprises a transistor 22*a* for controlling the current flowing through the fuel pump 4, fixed resistor 22*b* for protecting the transistor 22*a* against an overvoltage, a fixed resistor 22*c* for protecting the transistor 22*a* against an overcurrent, a brush secured to the shaft 21*c* and moves on a resistor surface of a variable resistor 22*d,* a diode 22*f* for absorbing the surge voltage generated at the fuel pump 4, a current control terminal 22*g,* a control input terminal 22*h* and a negative side terminal 22*i.*

The brush 22*e* is made of a phosphorous bronze plate for example which has an elasticity and a good electric conductivity, the shaft 21*c* is made of a stainless steel rod for example which has a slidability and an abrasion resistance and a good electric conductivity, the bearing 21*d* is made of a copper alloy for example which has a slidability and an abrasion resistance and a good electric conductivity, and the brush 22*e,* the shaft 21*c,* the bearing 21*d* and the variable resistor 22*d* are all electrically connected together.

Figure 3:
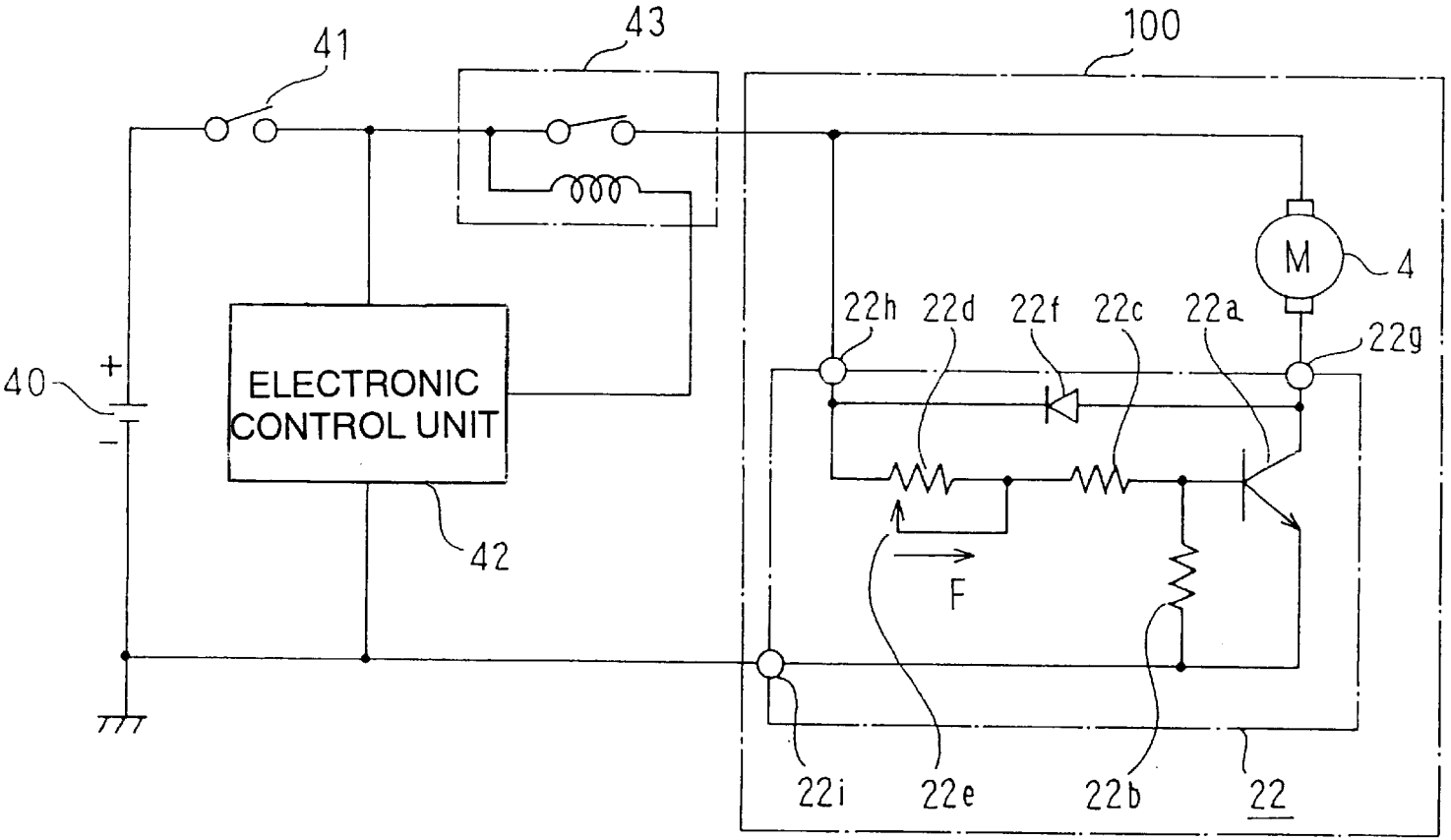
FIG. 3 is a connection diagram for a vehicle of the fuel supplying apparatus of one embodiment of the present invention.

FIG. 3 is a connection diagram for a vehicle of the fuel supplying apparatus of one embodiment of the present invention, in which 40 is a battery, 41 a key switch and 42 is an electronic control unit for electrically controlling the injector of the engine and for controlling an electric source relay 43 for switching on and off the electric source of the fuel pump 4. The output voltage from the electric source relay 43 is applied through the fuel pump 4 to the current control terminal 22*g* of the fuel pressure regulator 20 and to the control input terminal 22*h* of the fuel pressure regulator 20. The negative terminal of the battery 40 is not only grounded to the vehicle but also connected to the negative terminal 22*i* of the fuel pressure regulator 20.

The operation of the fuel supplying apparatus 100 thus constructed will now be described in conjunction with FIGS. 1 to 3.

When the key switch 41 is turned on, a voltage from the battery 40 is applied to the electronic control unit 42, the electric source 43 controlled by the electronic control unit 42 is turned on to supply an electric current to the control input terminal 22*h* of the fuel pressure regulator 20 and the fuel pump 4. When the voltage is applied to the control input terminal 22*h,* a base current flows to the transistor 22 through the fixed resistor 22*c* and a collector current proportional to the base current is supplied to the fuel pump 4 to drive the fuel pump 4.

When the fuel pump 4 is driven, the fuel within the fuel tank 2 is suctioned through the strainer 14 and discharged from the discharge pipe 11 to flow through the passage 15 in the direction of the arrow A, to reach to the lower space 16 under the filter element 5*b* after passing through the filter element 5*b,* thereafter the fuel is supplied to the injector of the fuel injection apparatus mounted to the unillustrated engine through the pipe 12 in the direction of the arrow B and through the discharge pipe 7.

In this fuel pumping process, when the diaphragm portion 21*a* of the fuel pressure detector portion 21 of the fuel pressure regulator 20 disposed in the fuel pipe receives the fuel pressure, the shaft 21*c* moves up and downwardly to cause the brush 22*e* secured to the shaft 21*c* to slide on the surface of the movable resistor 22*d,* whereby the resistance of the variable resistor 22*d* varies to control the base current flowing through the transistor 22*a*.

During the engine starting up, the fuel pressure within the fuel pipe connected from the pipe 12 to the injector through the discharge pipe 7 is low, so that the shaft 21*c* of the diaphragm portion 21*a* of the fuel detector portion 21 is positioned at a low position due to the compression spring 21*b* to cause the variable resistor 22*d* to exhibit a small resistance to allow a large base current to flow into the transistor 22*a*.

As a result, the current flowing through the fuel pump 4 increases, so that the unillustrated motor of the fuel pump 4 is operated at full power to increase the fuel pressure within the fuel pipe. When the fuel pressure is increased, the shaft 21*c* of the diaphragm portion 21*a* is moved upwardly (FIG. 3, in F direction) against the compression spring 21*b,* the resistance of the variable resistor 22*d* increases, thereby to make the base current flowing through the transistor 22*a* small to decrease the current flowing through the motor of the fuel pump 4.

In this manner, due to the functions of the current control unit 22 and the fuel pressure detection unit 21 housed within the fuel pressure regulator 20, the current flowing through the fuel pump 4 is made large when the fuel pressure within the fuel pipe is low and the current flowing through the fuel pump 4 is made small when the fuel pressure within the fuel pipe is high, whereby the fuel pressure within the fuel pipe supplied to the injector through the discharge pipe 7 is maintained at a prescribed value by analogue control of the current through the fuel pump 4 by a transistor 22*a*.

While it is proposed, as a method for maintaining the fuel pressure within the fuel pipe for supplying to the injector at a prescribed value, that a semiconductor pressure sensor is used to detect the fuel pressure based on which a field effect transistor is digital-controlled to control the current flowing through the fuel pump 4, when the digital turning on and off is carried out, because the motor of the fuel pump 4 is the induction-type load, a reverse voltage at a high voltage is generated across the fuel pump 4 and an electrical noise is generated.

Contrary to this, according to the present invention, the current flowing through the fuel pump 4 is controlled by the analogue control, the above problem does not generate.

Also, the fuel pressure, which is set by the specifications of the engine, the injector, the electronic control unit 42 and the like, can be set by suitably selecting the strength of the compression spring 21, the resistance of the variable resistor 22*d,* the resistance of the fixed resistor 22*c* and the current amplification factor of the transistor 22*a* housed within the fuel pressure regulator 20. It is effective to mount the fuel pressure regulator 20 as a unit after it is adjusted to have a prescribed value by a test device.

While the fuel pressure regulator 20 is described as being disposed on the upper surface of the cover 3 in the forgoing description, it may be disposed on the holder member 5*a* of the fuel filter 5, and the fuel filter 5 which has been housing within the holder member 5*a* may be inserted into the fuel pipe exterior of the fuel tank 2.

Another embodiment of the present invention will now be described.

Figure 4:
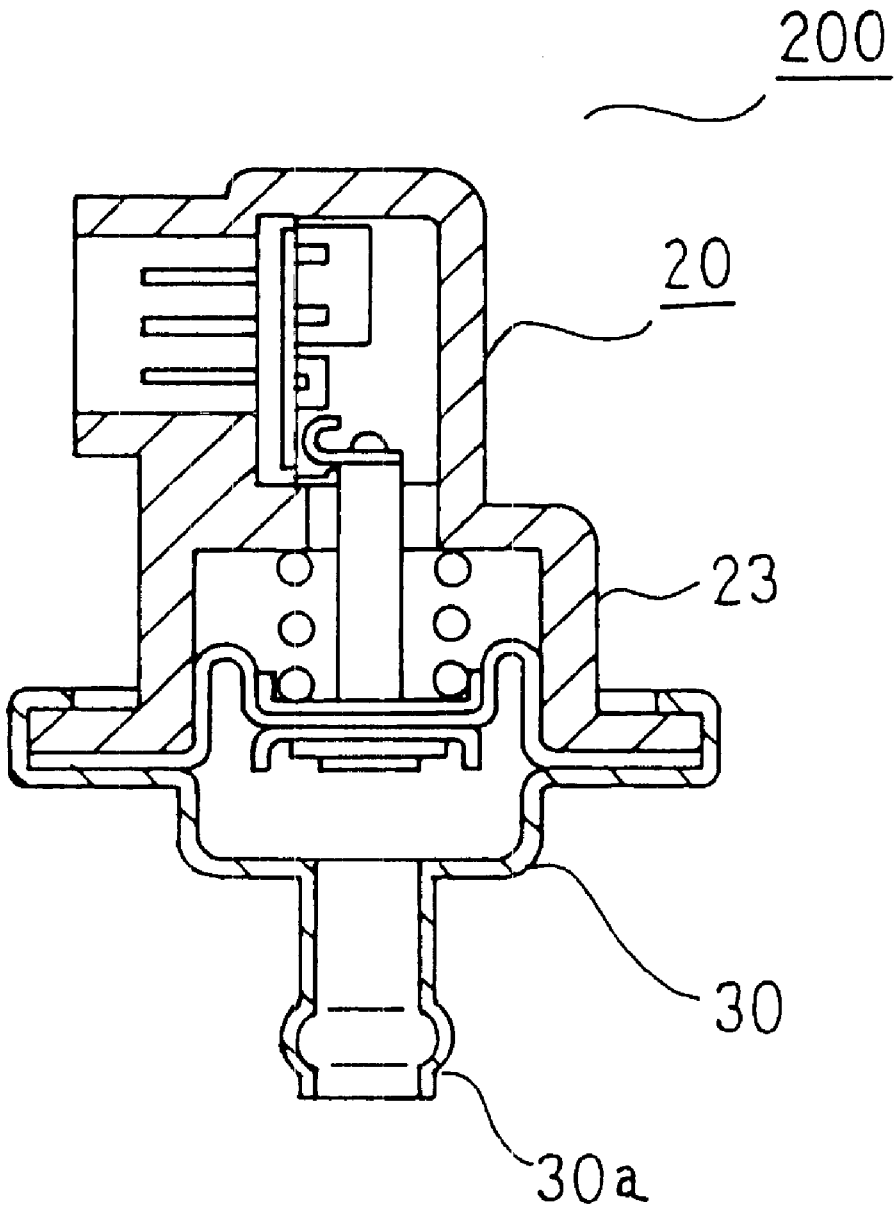
FIG. 4 is an enlarged sectional side view of the fuel pressure regulator of another embodiment of the present invention.
Figure 5:
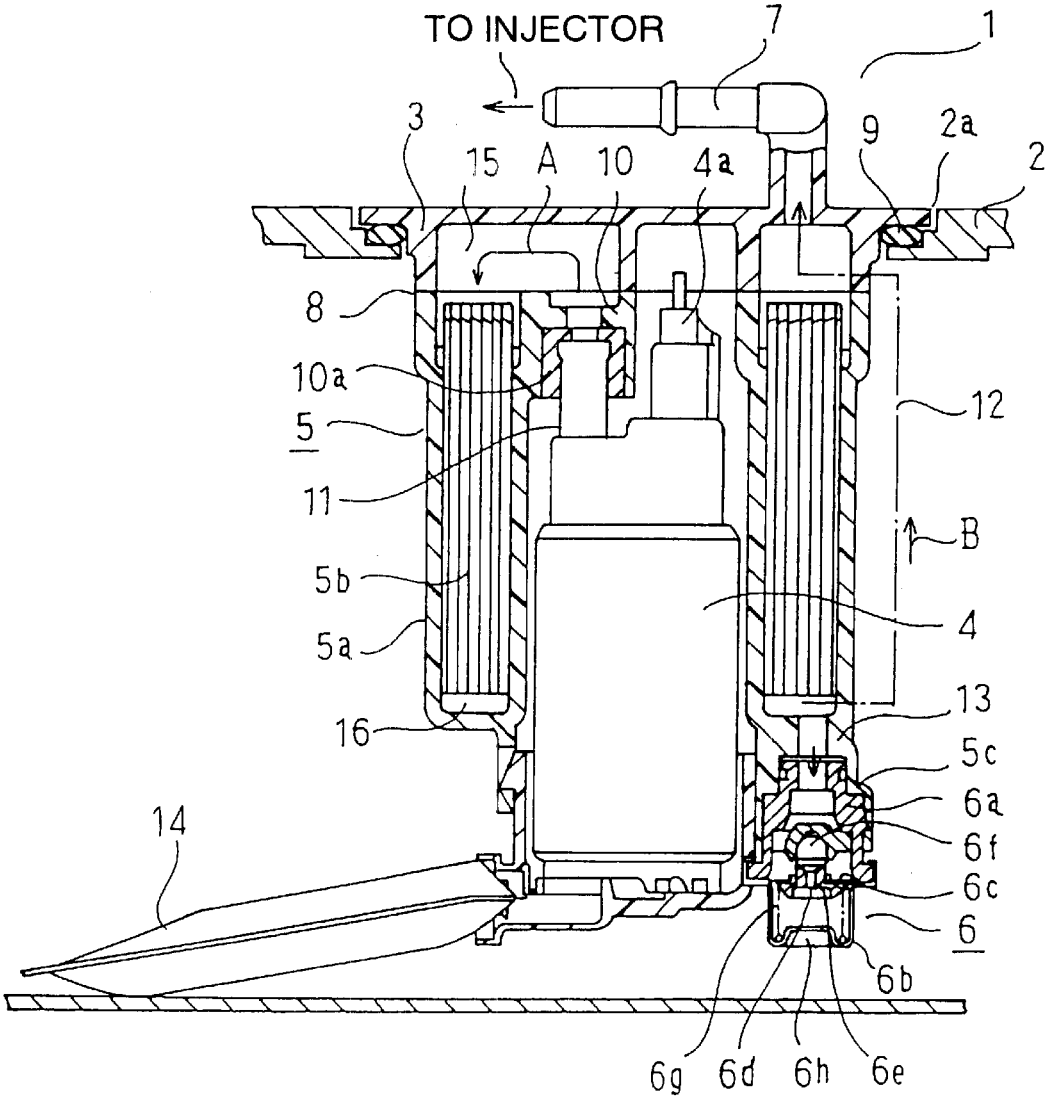
FIG. 5 PRIOR ART
FIG. 5 is a sectional side view of a conventional fuel supplying apparatus.

FIG. 4 is a sectional side view of the fuel pressure regulator of another embodiment of the present invention. In the figure, 200 is a fuel pressure regulator which has a suction portion 30 having a suction port 30*a* into which the fuel discharged from the fuel pump 4 flows secured to the lower portion of the case 23 of the fuel pressure regulator 22.

The fuel pressure regulator 200 is disposed within the fuel tank 2, outer surface portion of the fuel tank 2 or around the fuel pipe between the discharge pipe 7*a* and the injectors, and the fuel pipe and the suction port 30*a* are connected by the rubber hose or the like to detect the fuel pressure suctioned within the suction port 30*a,* whereby the fuel pressure suctioned in the suction port 30*a* is detected and analogue control the current flowing through the fuel pump 4 by the operation similar to that of the fuel supplying apparatus of the first embodiment, enabling the fuel pressure within the fuel pipe to be maintained at a prescribed value.

In the fuel supplying apparatus having the above-described construction, the fuel pump is operated to pump the fuel amount corresponding to that requested by the injector mounted to the engine, so that the current consumption of the fuel pump is reduced and the operating noise is lowered.

Also, the signal detected at the fuel pressure detection unit is inputted into the current control unit, enabling the current flowing into the fuel pump to be accurately controlled. Also, the fuel pressure detection unit comprises a diaphragm portion displaceable in response to the fuel pressure, the shaft and the axis, so that the fuel pressure can be detected by a simple structure.

Also, the current control unit comprises the transistor, the fixed resistor, the brush, the diode and the input terminal and allows the current flowing through the fuel pump to be accurately controlled by the analogue control.

Further, the fuel pressure regulator may be mounted to another position other than the fuel supplying apparatus, the layout design is easy.

INDUSTRIAL APPLICABILITY

The fuel supplying apparatus of the present invention comprises a cover portion installed to an opening portion of a fuel tank and having an outlet pipe disposed thereon, a fuel pump for pumping fuel within the fuel tank to an injector of an engine through the outlet pipe, a fuel filter for filtering the fuel discharged from the fuel pump, and a fuel pressure regulator for detecting the pressure of the fuel discharged from the fuel pump and regulating the discharge pressure of the fuel discharged from the pump according to the detected fuel pressure, so that the fuel pump is set to pump an amount of the fuel corresponding to that required by the injector mounted to the engine, whereby the current consumption of the fuel pump is reduced and the operating noise is lowered. Also, the motor of the fuel pump is rotated at a low speed when the engine noise is low such as during the idling, the operating noise can be low in order not to give an uncomfortable feeling to the passenger of the vehicle.

Further, the fuel pressure regulating apparatus of the present invention detects the fuel pressure to analogue control the motor current of the fuel pump for generating the fuel pressure, which is also applicable to a combination of the pressure of a medium other than the fuel and an electrical device for generating the pressure of the medium.

What is claimed is:

1. A fuel supply apparatus comprising:

a cover portion installed on an opening portion of a fuel tank and having an outlet pipe disposed thereon;

a fuel pump for pumping fuel within said fuel tank to an injector of an engine through said outlet pipe;

a fuel filter for filtering the fuel discharged from said fuel pump; and a fuel pressure regulator for detecting the pressure of the fuel discharged from said fuel pump and regulating the discharge pressure of the fuel discharged from said pump according to the detected fuel pressure;

wherein said fuel pressure regulator comprises a fuel pressure detection portion, and a control current portion for providing analogue control of the amplitude of the current flowing through said fuel pump according to a signal from said fuel pressure detection portion.

2. A fuel supplying apparatus as claimed in claim 1, wherein said fuel pressure regulator comprises a diaphragm portion displaceable in response to the fuel pressure, a compression spring for adjusting the displacement amount of said diaphragm portion and a shaft for guiding the movement of said diaphragm in a predetermined direction.

3. A fuel supply apparatus as claimed in claim 1, wherein said current control portion is composed of an analogue circuit comprising a variable resistor whose resistance varies according to the amount of displacement of a shaft, and a transistor whose base current is controlled according to said variable resistor.

4. A fuel pressure regulating apparatus comprising:

a suction portion for suctioning fuel;

a fuel pressure detection portion for detecting fuel pressure; and a current control portion for providing analogue control of the amplitude of a current flowing through a fuel pump according to a signal from said fuel pressure detection portion.

5. A fuel supply apparatus comprising:

a cover portion installed on an opening portion of a fuel tank and having an outlet pipe disposed thereon;

a fuel pump for pumping fuel within said fuel tank to an injector of an engine through said outlet pipe;

a fuel filter for filtering the fuel discharged from said fuel pump; and a fuel pressure regulator for detecting the pressure of the fuel discharged from said fuel pump and regulating the discharge pressure of the fuel discharged from said pump according to the detected fuel pressure;

wherein said fuel pressure regulator comprises a fuel pressure detection portion, and a control current portion for controlling the current flowing through said fuel pump according to a signal from said fuel pressure detection portion.

wherein said fuel pressure regulator comprises a diaphragm portion displaceable in response to the fuel pressure, a compression spring for adjusting the displacement amount of said diaphragm portion and a shaft for guiding the movement of said diaphragm in a predetermined direction.

6. A fuel supplying apparatus according to claim 4, wherein said fuel pressure regulator comprises a diaphragm portion displaceable in response to the fuel pressure, a compression spring for adjusting the displacement amount of said diaphragm portion and a shaft for guiding the movement of said diaphragm in a predetermined direction.

7. A fuel supply apparatus as claimed in claim 4, further comprising a shaft, wherein said current control portion includes an analogue circuit comprising a variable resistor whose resistance varies according to the amount of displacement of the shaft, and a transistor whose base current is controlled according to said variable resistor.

* * * * *